US009719264B1

(12) United States Patent
McCartney et al.

(10) Patent No.: US 9,719,264 B1
(45) Date of Patent: Aug. 1, 2017

(54) PARTITION MOLDING

(71) Applicant: USG Interiors, LLC, Chicago, IL (US)

(72) Inventors: Nicholas McCartney, Harwood Heights, IL (US); James J. Lehane, McHenry, IL (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 15/241,130

(22) Filed: Aug. 19, 2016

(51) Int. Cl.
*E04F 13/06* (2006.01)
*E04F 13/07* (2006.01)
*E04F 13/22* (2006.01)

(52) U.S. Cl.
CPC ..... *E04F 13/068* (2013.01); *E04F 13/07* (2013.01); *E04F 13/22* (2013.01); *E04F 2013/063* (2013.01)

(58) Field of Classification Search
CPC ..... E04F 13/068; E04F 13/07; E04F 13/22; E04F 2013/063
See application file for complete search history.

(56) References Cited

U.S. PATENT DOCUMENTS 1,030,044 A * 6/1912 Wittbecker ..... E04F 13/06 52/255
3,318,061 A * 5/1967 Stentz ..... E04F 19/028 248/345.1
4,763,455 A * 8/1988 Schneller ..... E04F 13/06 52/255
5,313,755 A * 5/1994 Koenig, Jr. ..... E04F 13/06 52/255
9,234,348 B1 1/2016 Lehane et al.
9,482,010 B2 * 11/2016 Kartler ..... E04F 13/0733

FOREIGN PATENT DOCUMENTS

CH DE 102004025862 A1 * 1/2006 ..... E04F 13/06

OTHER PUBLICATIONS

Screen shots of pp. 1 and 25 from Trim-Tex Inc. website and Detail Profile of Model No. 5008, dated at least as early as Aug. 1, 2015.

* cited by examiner

*Primary Examiner* — Jeanette E Chapman
(74) *Attorney, Agent, or Firm* — Pearne & Gordon LLP

(57) ABSTRACT

A partition molding of a metal strip having a right angle cross-section with a vertical leg and a horizontal leg joined at a corner, the horizontal leg having a hem distal from the corner and projecting above a main part of the horizontal leg, the vertical leg having a series of regularly spaced holes for reception of drywall screws used to attach the molding to a wall whereby contact force between the molding and an overlying ceiling is concentrated at the hem and a reaction force can create a moment that serves to urge a lower edge of the vertical leg against a wall on which the molding is mounted.

5 Claims, 2 Drawing Sheets

PARTITION MOLDING

BACKGROUND OF THE INVENTION

The invention relates to drywall construction and, in particular, to a molding for the intersection of a wall and an existing suspended ceiling.

PRIOR ART

Partition walls are often built after a suspended ceiling has been constructed, especially in remodeling or reconfiguration of existing spaces. Architects and interior designers prefer that the appearance at the upper edge of the partition wall being erected matches the wall angle trim of preexisting perimeter walls.

The prior art includes an extruded plastic angle molding intended for use with partition walls being constructed in spaces with existing suspended ceilings. This plastic molding has several disadvantages including an appearance that is distinguishable from standard wall angles. Once installed, the plastic trim is too resilient to be permanently bent to follow minor deviations in the ceiling and wall intersection from a true straight line. Small but discernable gaps between the plastic molding are, consequently, difficult to avoid.

The extruded thickness of the prior art plastic molding, used to impart some degree of stiffness, has the disadvantage of requiring a thick layer of joint compound to conceal its edges. Thus, in turn, the molding can require greater drying time for the joint compound. Typically, plastic molding is adhered or stapled to the wall. This leaves the molding vulnerable to moderate stress and strain causing the trim to separate from the wall even after it is finished with joint compound. Fastening with screws can be impractical because the plastic has a tendency to lift up in areas surrounding a screw. Since the described plastic molding is not regularly used, installers are not always familiar with techniques required to adequately install it.

To avoid using plastic trim, installers are known to use regular wall angle. This process is tedious since the upstanding vertical leg of the wall angle must be carefully notched to accommodate the ceiling grid elements. Additionally, a backer behind the drywall is commonly used to anchor the screws used to attach the wall angle. These backers are individually cut to fit between adjacent grid elements and are then screwed or otherwise fixed in position.

There remains a need for a molding for the described construction that is easy to install and, once installed, is resistant to separation from the wall and that can be permanently shaped to conform to local wall and ceiling run out from ideal straight conditions.

SUMMARY OF THE INVENTION

The invention provides a partition molding for use with existing suspended ceilings. The disclosed molding is made of a pre-painted strip of ductile sheet steel by conventional roll-forming techniques. The molding is characterized by a hem on a horizontal leg that matches the visible part of conventional suspended ceiling wall angle. When the molding is installed, the hem, additionally, can bias a lower edge of a vertical leg against the partition wall drywall. This and the relatively thin gauge of the metal strip can assure that the leg is concealed with a minimal thickness of drywall compound. A small reverse angle is provided at the corner of the molding to serve as a screed for guiding a taping trowel when burying the vertical leg with joint compound. The vertical leg is lanced to form holes for screws that attach the molding to a wall. Tabs displaced from the holes on the backside of the vertical leg have sharp edges that can bite into the paper cladding of the drywall enabling the molding to be temporarily held in a desired location with minimal finger force until it is fixed with fastening screws. The metal strip material has sufficient ductility to permit the molding to be permanently bent during installation so that the visible part is caused to more closely follow the line of the ceiling.

DESCRIPTION OF THE PREFERRED EMBODIMENT

Figure 1:
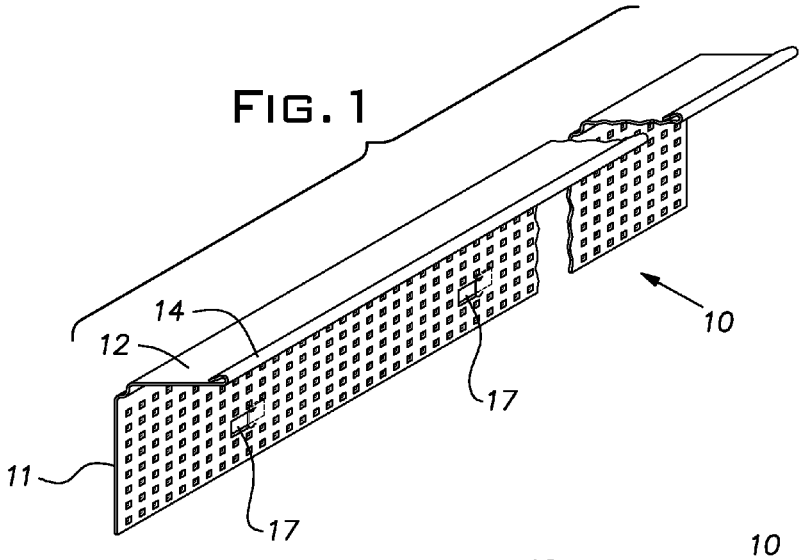
FIG. 1 is a perspective fragmentary view of a partition molding of the invention.

Referring to the drawings, a partition molding 10 is an elongated sheet metal body in the general form of a right angle. The molding 10 is preferably a sheet metal strip roll formed into the illustrated shape. The molding 10 has a vertical leg 11 and a horizontal leg 12 joined at a corner 13. A side of the strip is pre-painted before it is rolled into the angular shape and is otherwise processed to its final configuration. The painted side forms the bottom of the horizontal leg 12. The corner 13 is formed as a small right angle oriented oppositely of the right angle of the molding proper. The sheet steel used to form the molding 10 can be, for example, type CS-B G-30 HDG (hot dipped galvanized) made within the standards of ASTM 653. This material has a ductility measured by an elongation in two inches of 20% or more. The horizontal leg 12 distal from the corner 13 includes an upturned and reverse-folded hem 14, made at the margin of the strip, similar to that provided on conventional wall angle as is well known in the industry. The width of the horizontal leg, not including the reverse corner 13, ideally matches that of conventional wall angles and is, for example, either 9/16 inch or 7/8 inch. The vertical leg, including the corner 13, can measure 1.15 inch, for example. The molding can be supplied in lengths of 10 feet, for example. The gauge of the strip material of the molding 10 can be 0.019 inch, for example. Dimensions expressed in this disclosure are intended to include their industry metric equivalents. The offset of the sides of the reverse corner 13 from the main parts of the vertical and horizontal legs 11, 12 can, for example, be 0.090 inch or, about, 3/32 inch.

An outer face (with reference to an installed orientation) of the vertical leg 11 is knurled with small square indentations to improve adhesion of joint compound. At regularly spaced locations of 2 inches, for example, the vertical leg 11 is lanced to form a rectangular hole 17 and a rectangular tab 18 of material from the hole. The hole 17 is cut on three sides and the tab 18 is folded back at a 4th side. The hole can measure 0.16 inch square, for example, enabling it to receive a number 6 drywall screw without interference with the thread crests and to prevent passage of its head.

For reference purposes and by way of example, the height of the hem above a lower face of the horizontal leg 12 can be 0.078 inch or about 5/64 inch.

Figure 5:
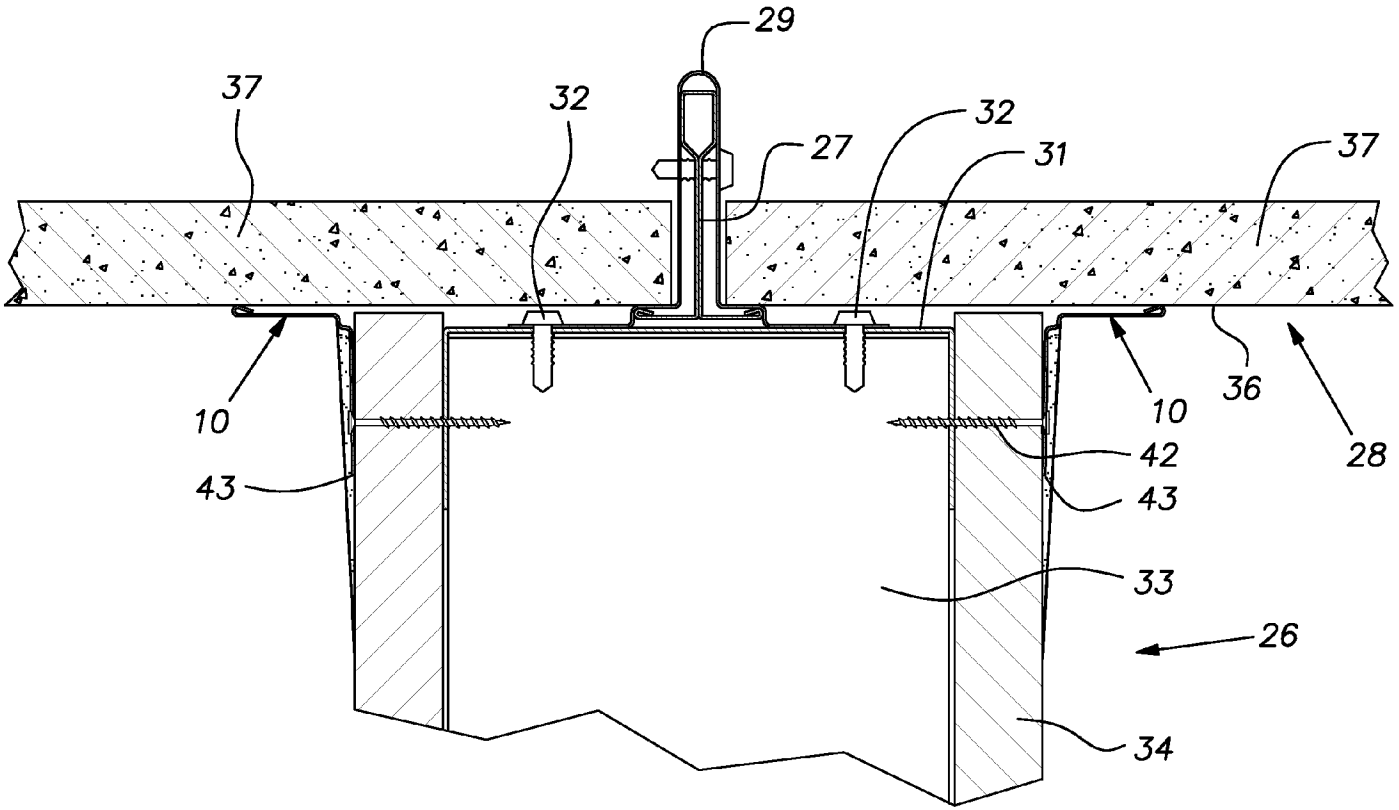
FIG. 5 is a fragmentary cross-sectional view of an upper portion of a partition wall and a suspended ceiling.

FIG. 5 shows an example of an installation of the inventive molding 10 on a drywall partition wall 26. The illustrated wall 26 is constructed directly and symmetrically below a grid tee or runner 27 of a grid of a pre-existing suspended ceiling 28. Attachment clips 29, with an inverted tee configuration, are assembled over the grid tee 27 at spaced locations above the space where the wall 26 is to be situated. An inverted U-shaped sheet metal stud track 31 is attached to flanges of the clip 29 with screws 32. The stud track, of known construction, receives upper ends of sheet metal studs 33 (only one is illustrated in FIG. 5) serving as a plate to connect the studs on, for example, 16 inch or 24 inch centers. Alternatively, the wall framing can be wood. Sheets of drywall 34 are attached to opposite sides of the studs 33 and track 31.

With the drywall sheets 34 in place, the molding 10 is located on the drywall so that the hem 14 is at the plane of the ceiling 28 represented by a lower surface 36 of a ceiling tile 37. The angle between the molding legs 11, 12 can be manufactured to be slightly greater than 90 degrees, i.e. nominally 92 degrees.

Figure 3:
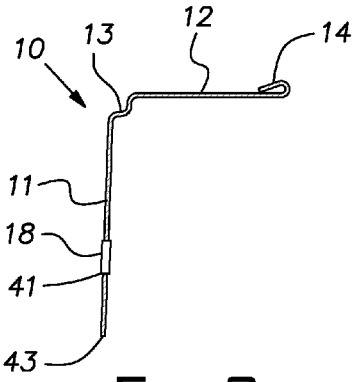
FIG. 3 is a cross-sectional view of the molding taken in the plane 3-3 in FIG. 2.
Figure 2:
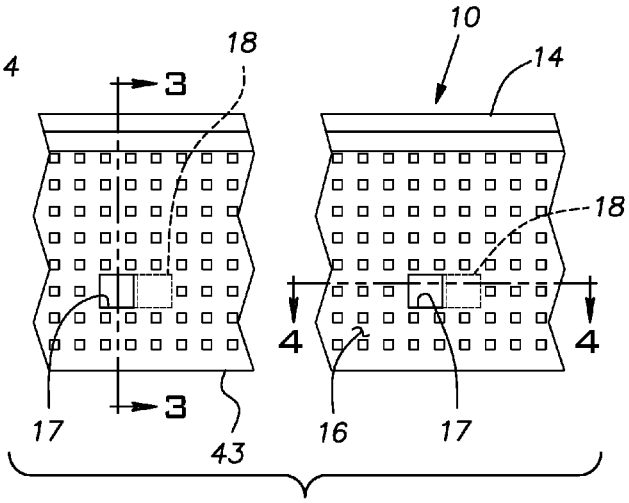
FIG. 2 is a fragmentary front side elevational view of the molding.
Figure 4:
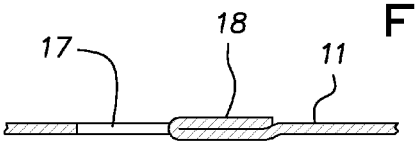
FIG. 4 is a cross-sectional view of the molding taken in the plane 4-4 in FIG. 2.

The lanced tabs 18, as shown in FIG. 4, project out of the plane of the vertical leg 11 enabling horizontal sharp edges 41 (FIG. 3) to bite or grip into the paper covering of the drywall 34 with relatively little hand pressure applied to the molding 10. Once the molding 10 is determined to be in a correct position, light hand pressure will lock it in position against gravity until fastened by a screw 42. A screw 42 inserted in a proximal hole 17 is driven through the drywall sheet 34, a depending flange of the track 31 and, in some instances, a flange of a stud 33. Preferably, the head of the screw locally pulls the sheet metal of the molding leg 11 into the drywall so that the head is substantially flush or countersunk below the outer surface of the leg 11. Where, as shown, a stud track 31 or other member serving as a plate, is available at the inner top of a wall, the molding 10 requires no additional backing for securement by screws.

Since the upper part of the hem 14 is higher than remaining parts of the horizontal leg, a reaction force from contact with parts of the ceiling will tend to rotate the molding in a direction which will bias a lower edge 43 of the vertical leg against the drywall sheet 34. This can occur where a tab 18 serves as a fulcrum for the pivoting movement or where finger pressure is applied against the vertical leg 11 in both vertically upward and horizontally inward directions.

After being fixed to the wall 26 with screws 42, the vertical leg 11 can be concealed with joint compound. The vertical offset of the reverse corner 13 serves as a screed for a taping knife or trowel. Joint compound applied in one or more coats tapers inwardly from the reverse corner 13 to a vanishing line several inches below the reverse corner. The joint compound conceals the vertical leg including its lower edge 43 and heads of the screws 42. If desired, joint tape can be applied over the vertical leg to improve the resistance of the joint compound to cracking. The thin gauge 0.019 inch of the molding 10 requires only a minor average thickness of the tapered layer of joint compound to conceal the molding 10 particularly at its lower edge 43. This reduced volume of joint compound can reduce drying time.

The described molding is somewhat malleable or ductile so that it can be manually bent up or down especially along the free or distal edge of the horizontal leg 12 to conform this leg to the ceiling where the ceiling 28 or wall 26 are not perfectly flat, for instance. Where the wall 28 deviates from a flat plane and the vertical leg is drawn against it, the horizontal leg has a tendency to be drawn up or down in a buckling mode. This deflection can be corrected manually by permanently bending the horizontal leg 12 up or down as needed. Plastic moldings are too resilient to permit this type of adjustment. Where an end of the molding 10 intersects an existing wall angle, the molding can be trimmed by cutting the horizontal leg 12 at a 45 degree angle and by positioning it under the existing wall angle to create a faux miter joint. This is not practical with a plastic molding because of the necessary thickness used to obtain stiffness in the plastic molding.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A partition molding of an elongated roll formed ductile steel sheet metal strip, the molding having a right angle cross-section with a vertical leg and a horizontal leg joined at a corner, the vertical leg having a series of regularly spaced holes for reception of drywall screws used to attach the molding to a wall, a series of sharp projections on a side of the vertical leg facing away from a side of the vertical leg from which the horizontal leg projects adapted to grip a vertical drywall surface on which the molding is being located, a marginal area of the strip at a distal edge of the horizontal leg is folded back to form a hem that projects above a portion of the horizontal leg between the hem and the corner.

2. A molding as set forth in claim 1, wherein the sharp projections are adjacent the holes.

3. A molding as set forth in claim 2, wherein the sharp projections are formed by material displaced from the holes.

4. A molding as set forth in claim 3, wherein the sharp projections are edges of tabs lanced from the vertical leg to form said holes.

5. A molding as set forth in claim 1, wherein the corner between the vertical and horizontal legs includes a reverse corner of dimensions small in comparison to the width of the vertical leg and the horizontal leg.

* * * * *